US010895239B2

(12) United States Patent
Fujita

(10) Patent No.: US 10,895,239 B2
(45) Date of Patent: Jan. 19, 2021

(54) PINION GEAR AND STARTER WITH PINION GEAR

(71) Applicant: DENSO CORPORATION, Kariya (JP)

(72) Inventor: Tatsuya Fujita, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 16/708,573

(22) Filed: Dec. 10, 2019

(65) Prior Publication Data

US 2020/0224629 A1 Jul. 16, 2020

(30) Foreign Application Priority Data

Jan. 15, 2019 (JP) ..... 2019-004767

(51) Int. Cl.

| | |
|---|---|
| ***F02N 15/06*** | (2006.01) |
| ***F02N 15/02*** | (2006.01) |
| *F02N 15/04* | (2006.01) |
| *F02N 11/00* | (2006.01) |

(52) U.S. Cl.

CPC ..... *F02N 15/067* (2013.01); *F02N 15/022* (2013.01); *F02N 11/00* (2013.01); *F02N 15/046* (2013.01); *F02N 15/065* (2013.01); *F02N 2015/061* (2013.01)

(58) Field of Classification Search

CPC .... F02N 15/067; F02N 15/022; F02N 15/065; F02N 15/046; F02N 15/063; F02N 11/00; F02N 2015/061

USPC ..... 123/192.1, 179.25

See application file for complete search history.

(56) References Cited

FOREIGN PATENT DOCUMENTS

| | | |
|---|---|---|
| WO | 2010/136429 A1 | 12/2010 |
| WO | 2013/060620 A1 | 5/2013 |

*Primary Examiner* — Hai H Huynh

(74) *Attorney, Agent, or Firm* — Oliff PLC

(57) ABSTRACT

To suppress generation of noise during cranking, a pinion gear is fixed to a drive shaft of a starter starting an internal combustion engine. The pinion gear rotates a ring gear provided to the internal combustion engine by meshing therewith. The pinion gear includes gear teeth and an annular hollow portion located radially inside of the gear teeth. The annular hollow portion accommodates a vibration absorber to absorb vibration generated in the gear tooth.

13 Claims, 7 Drawing Sheets

PINION GEAR AND STARTER WITH PINION GEAR

CROSS-REFERENCE TO RELATED APPLICATION

This patent application is based on and claims priority to Japanese Patent Application No. 2019-004767, filed on Jan. 15, 2019 in the Japan Patent Office, the entire disclosure of which is hereby incorporated by reference herein.

BACKGROUND

Technical Field

Embodiments of this disclosure relate to a pinion gear and a starter with the pinion gear for starting an internal combustion engine.

Related Art

To start an internal combustion engine, a starter drives a motor that rotates a pinion gear meshing with a ring gear attached to the internal combustion engine. However, when the pinion gear meshes with the ring gear, teeth of these gears mutually collide and generate a collision noise or the like. To suppress such a noise, various prior art technologies have been proposed.

SUMMARY

Accordingly, one aspect of the present disclosure provides a novel pinion gear fixed to a drive shaft of a starter starting an internal combustion engine. The pinion gear rotates a ring gear provided to the internal combustion engine by meshing therewith. The pinion gear includes gear teeth disposed on its outer circumference and a hollow portion located inside of the gear teeth, and a vibration absorber stored in the annular hollow portion. The vibration absorber has a higher vibration absorption property than a portion of the pinion gear surrounding the annular hollow portion.

When a starter 10 starts a combustion engine, compression and expansion are repeated in a cylinder of the combustion engine. In a cylinder compression stage, since a pinion gear needs to overcome a compression reaction force and rotate a ring gear, a large load is generated between the pinion gear and the ring gear. Further, during a cylinder expansion stage, since the ring gear is accelerated by expansion of a compressed gas in a direction of rotation thereof, a pinion gear is rotated by the ring gear. In this situation, a face of a tooth of the pinion gear contacting the ring gear and receiving a stress therefrom is alternated with another face of the tooth, and vibrations of a sliding noise and a collision noise respectively caused by sliding and collision of the ring gear and the pinion gear therebetween are transmitted from the faces to the pinion gear and the ring gear. Due to absence of attenuation of these vibrations, unpleasant noises remain such that the noise either becomes louder or echoes.

In view of this, according to one aspect of the present disclosure, transmission of the vibrations from the gear teeth to a drive shaft is either suppressed or reduced by the annular hollow portion in the pinion gear with the above-described configuration. Further, the vibration transmitted to the annular hollow portion is absorbed by the vibration absorber stored in the hollow portion, the vibration can be more effectively either suppressed or reduced. Further, vibration generated in the ring gear by contacting the pinion gear can be satisfactorily reduced in a process in which the vibration is transmitted due to the contact from the ring gear toward an axis of the pinion gear. That is, the vibration of the ring gear can also be reduced. That is, if the ring gear and the pinion gear are in contact with each other so that the vibration is transmitted efficiently from the ring gear to the pinion gear, a cranking noise generated in the pinion gear and the ring gear side can be efficiently reduced. As a result, the sliding noise, the collision noise and a rolling noise or the like generated between the pinion gear and the ring gear can be damped and reduced. That is, if the ring gear and the pinion gear are in contact with each other to allow to transmit the vibration from the ring gear to the pinion gear efficiently, a cranking noise generated in the pinion gear and the ring gear can be efficiently reduced.

BRIEF DESCRIPTION OF THE DRAWINGS

A more complete appreciation of the present disclosure and many of the attendant advantages of the present disclosure will be more readily obtained as substantially the same becomes better understood by reference to the following detailed description when considered in connection with the accompanying drawings, wherein.

DETAILED DESCRIPTION

As discussed in International Patent Application Publication No. 2010-136429 (WO-2010-136429-A)), a tooth of a pinion gear is divided into plural pieces in a thickness direction of the pinion gear to suppress the collision noise when the starter performs cranking. However, another noise is generated. The present invention is made in view of such a problem, and an object thereof is to address the problem.

Figure 1:
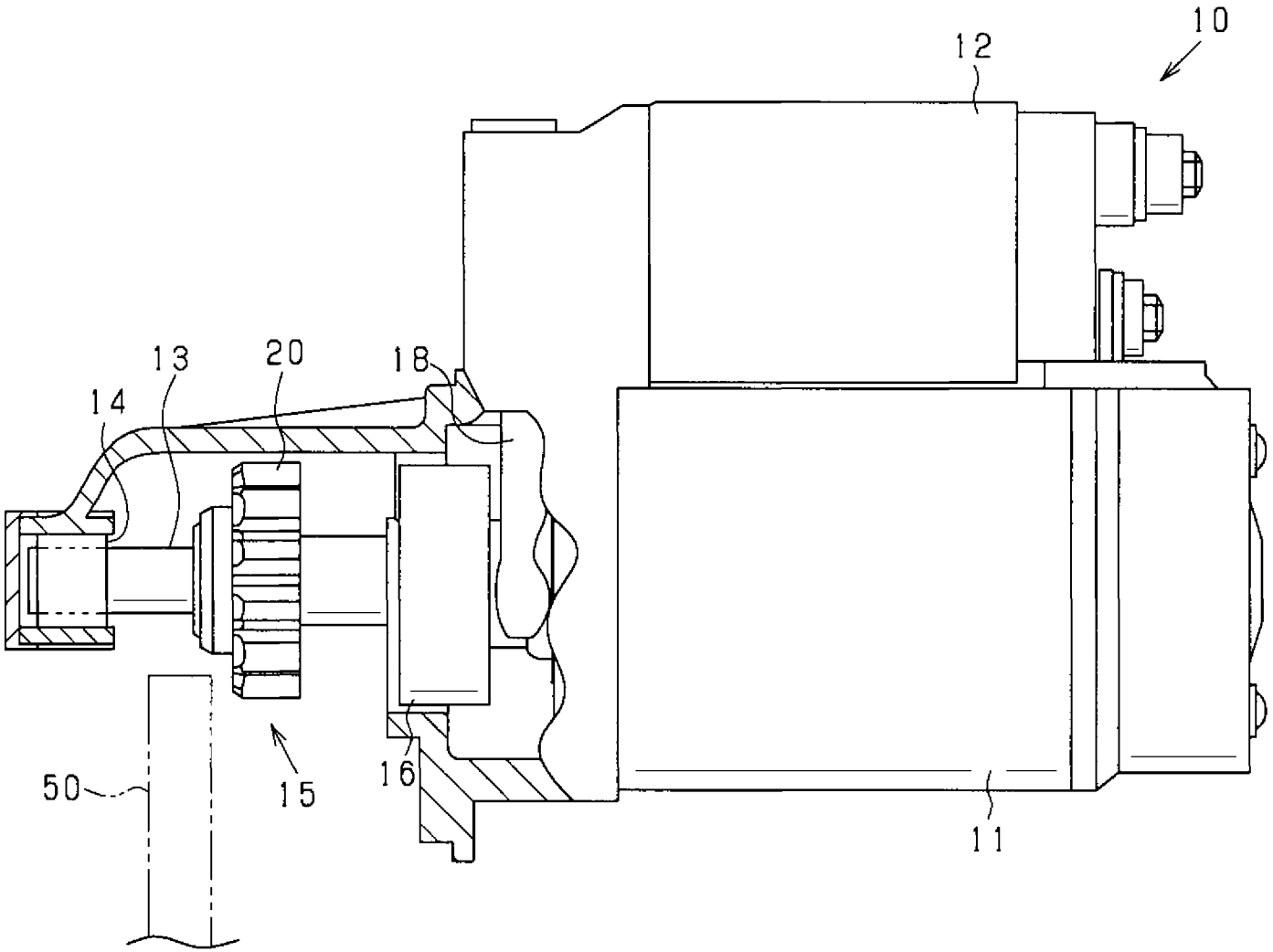
FIG. 1 is a schematic diagram illustrating an exemplary configuration of a starter according to a first embodiment of the present disclosure.

Referring now to the drawings, wherein like reference numerals designate identical or corresponding parts throughout the several views thereof, and to FIG. 1 and applicable drawings, a configuration of a pinion gear employed in a starter to start an engine is described according to a first embodiment of the present disclosure. As illustrated in FIG. 1, a starter 10 is generally mounted on a vehicle to start an in-vehicle engine (i.e., an internal combustion engine). The starter 10 includes a DC (direct current) motor 11 and a magnet switch 12 acting as a switch turned on to supply power to the DC motor 11. When power is supplied to the magnet switch 12, an energization circuit extended from a battery to the DC motor 11 is closed thereby supplying power from the battery to the DC motor 11. Hence, rotational force is generated and is transmitted from the DC motor 11 to a drive shaft 13 thereby rotating the drive shaft 13.

Between the DC motor 11 and the drive shaft 13, a deceleration device such as a planetary gear speed reducer (not shown), etc., is provided to decelerate a rotation speed and transmit rotation of the DC motor 11 to the drive shaft 13. Specifically, a rotation shaft (not shown) of the DC motor 11 slowly drives the drive shaft 13 through the speed reducer. Further, an end of the drive shaft 13 facing the DC motor 11 (i.e., a right side in FIG. 1) is supported by the speed reducer. Instead of the speed reducer, the rotation shaft of the DC motor 11 can also act as the drive shaft 13 of the DC motor 11. Further, another end of the drive shaft 13 opposite to the DC motor 11 is supported by a bearing 14.

A pinion carriage 15 is attached to the drive shaft 13 to be able to move in its axial direction. The pinion carriage 15 includes an over-running clutch 16 (hereinafter simply referred to as a clutch 16) that connects with an outer periphery of the drive shaft 13 by helical spline coupling. The pinion carriage 15 also includes a pinion gear 20 enabled to mesh with a ring gear 50 included in the engine. The clutch 16 is composed of a one-way clutch employing a well-known cam system. Specifically, the clutch 16 includes an outer attached to the drive shaft 13, an inner rotatably attached thereto in the outer, and a clutch roller for either transmitting or blocking a rotational torque between the outer and the inner. The clutch 16 thus transmits a rotational torque only in a single direction.

The pinion gear 20 is integrally movable with the clutch 16 on an outer periphery of the drive shaft 13 in the axial direction (i.e., a lateral direction in FIG. 1). The pinion gear 20 is attached to the unit at a position further away from the motor 11 than the clutch 16. The pinion gear 20 is rotated by a rotation torque generated by the DC motor 11.

Hence, when the starter switch and the magnet switch 12 are turned on, a shift lever 18 depresses the pinion carriage 15 away from the motor until the pinion gear 20 meshes with the ring gear 50 of the engine. At the same time, the DC motor 11 is rotated and performs cranking thereby starting the engine. By contrast, when the starter switch is turned off, the DC motor 11 stops rotating and the shift lever 18 biased by a return spring (not shown) depresses the pinion carriage 15 in the axial direction toward the DC motor 11 until the pinion gear 20 disengages with the ring gear 50.

Figure 2:
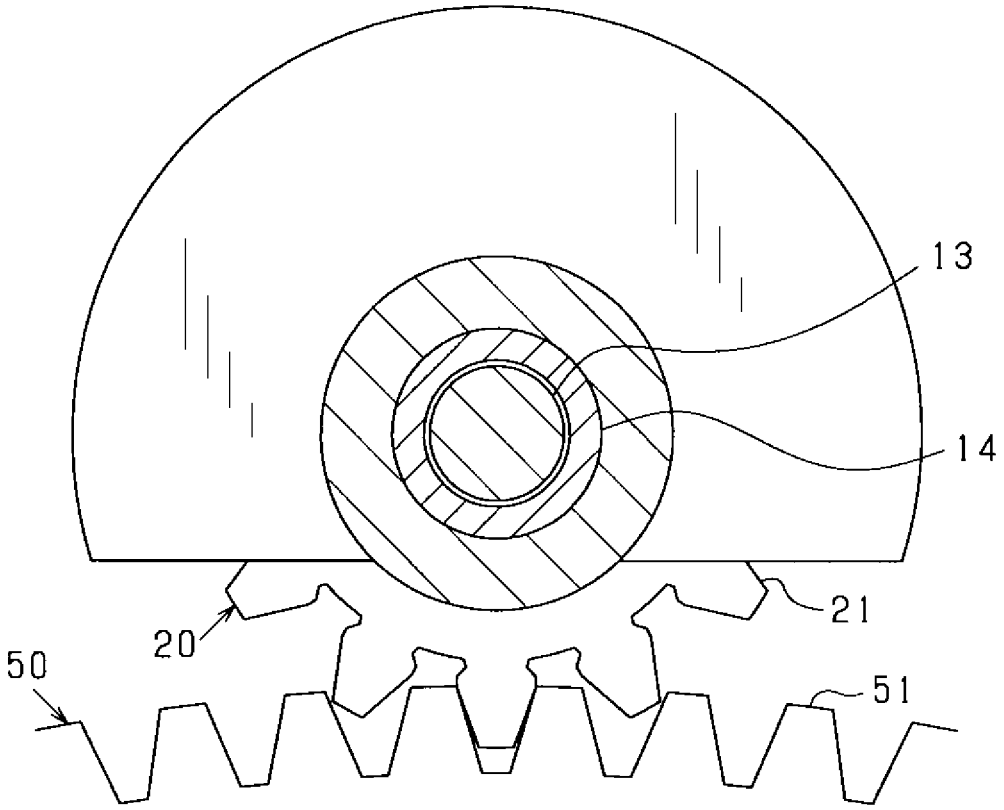
FIG. 2 is a diagram illustrating a meshing status of a pinion gear and a ring gear meshing with each other according to the first embodiment of the present disclosure.

Now, with reference to FIG. 2, a meshing condition and a mechanism of force application to each of the pinion gear 20 and the ring gear 50 when the pinion gear 20 rotates and drives the ring gear 50 in the meshing condition are herein below described. That is, FIG. 2 is a cross-sectional view illustrating a bearing 14 and the pinion gear 20 perpendicular to the drive shaft 13 shown in FIG. 1.

Each of the pinion gear 20 and the ring gear 50 is composed of a spur gear and meshes with each other with respective tooth faces mutually in contact. The pinion gear 20 has a relatively small diameter. The number of gear tooth 21 of the pinion gear 20 is from about eight to about fifteen. By contrast, the ring gear 50 has a relatively large diameter and is fixed to a flywheel of the engine. A given offset is provided between the gear tooth 21 of the pinion gear 20 and a gear tooth 51 of the ring gear 50 to ease engagement of the pinion gear 20 with the ring gear 50 when the pinion gear 20 is moved in the axial direction. Instead of the spur gear, each of the pinion gear 20 and the ring gear 50 can employ a helical gear.

When the pinion gear 20 is meshed with the ring gear 50 and the DC motor 11 of the starter 10 is driven to perform cranking, a rotational speed of the engine pulsates. This pulsation generates a vibration and a cranking noise in each of the pinion gear 20 and the ring gear 50. During the cranking of the engine caused by the starter 10, compression and expansion are repeated in a cylinder of the engine. Hence, during a compression stage of the cylinder, since the number of revolutions of cranking decreases and a large load is generated between the pinion gear 20 and the ring gear 50 due to a compression reaction force, a large cranking noise occurs due to sliding of these gears on each other and rolling of these gears. By contrast, during an expansion stage of the cylinder, since the ring gear 50 is rotated at a high speed due to expansion in the expansion stage of the engine, the pinion gear 20 is possibly rotated by the ring gear 50. That is, a tooth face of the gear teeth 21 of the pinion gear 20 receiving a stress alternates with an adjacent tooth face thereof.

When the stress receiving tooth face alternates with another, since either the ring gear 50 and the pinion gear 20 are temporarily separated from each other or a contact pressure generated therebetween is reduced, vibration caused by the cranking remains and cannot be damped in the ring gear 50. Therefore, a large cranking noise is prominently generated by the collision, the sliding and the rolling of the ring gear 50 and the pinion gear 20. Further, since the ring gear 50 is bigger than the pinion gear 20, vibration of the ring gear 50 generated by the cranking is less likely to be damped and thereby easily generates noise. However, the vibration generated in such a ring gear 50 can be efficiently damped by contacting the ring gear 50 with the pinion gear 20.

Specifically, when cylinder compression is performed, the pinion gear 20 is rotated by a rotational torque generated by the DC motor 11, and the ring gear 50 is rotated by a rotational torque generated by the pinion gear 20. In particular, a compression reaction force is maximized immediately before transition of a stroke from the compression stroke to the expansion stroke. Hence, the ring gear 50 is decelerated by the compressive reaction force increasing in this way in the compression stroke. At this moment, since a large amount of current flows through it, the DC motor 11 generates a torque prevailing over the compression reaction force. Hence, since the torque generated by the DC motor 11 is maximized just before the end of the compression stroke, large forces act on the pinion gear 20 and the ring gear 50 resulting in generation of large sliding and rolling noises therebetween.

Further, when the stroke changes from the compression stroke to the expansion stroke, since the expansion in the cylinder accelerates rotation the engine, the ring gear 50 comes to rotate at a higher speed and does not contact with (i.e., separates from) the pinion gear 20. As a result, since the ring gear 50 and the pinion gear 20 do not contact with (i.e., separate from) each other, the vibrations of the pinion gear 20 and the ring gear 50 generated in the compression stroke respectively spread radially in the pinion gear 20 and the ring gear 50. Accordingly, the vibrations are not damped or stopped. Hence, the generated noise (i.e., the cranking noise) cause echoes without decreasing.

Further, during the expansion in the cylinder, the ring gear 50 is rotated in a forward direction by expansion of compressed gas therein. At this moment, when the ring gear 50 rotates at a higher speed than the pinion gear 20, the pinion gear 20 is rotated by the ring gear 50. However, since transmission of the rotation of the pinion gear 20 to the DC motor 11 is blocked by the clutch 16, the pinion gear 20 is readily driven by the ring gear 50. Further, when the pinion gear 20 is driven by the ring gear 50, the ring gear 50 and the pinion gear 20 collide with each other on respective tooth faces opposite to driving tooth faces on which the ring gear 50 and the pinion gear 20 collide with each other in the compression stroke. Since a contact pressure between the ring gear 50 and the pinion gear 20 is relatively small, transmission of vibration from the ring gear 50 to the pinion gear 20 is relatively small. Therefore, vibration caused by collision, sliding and rolling when the pinion gear 20 is driven by the ring gear 50 is not damped within the pinion gear 20. Thus, the vibrations of the pinion gear 20 and the ring gear 50 generated in the expansion stroke respectively spread radially within these gears 20 and 50 and remain without attenuating. Therefore, the noise generated by the vibration (i.e., the cranking noise) grows without decreasing.

Hence, to suppress the cranking noise, spreading of the vibration without attenuation in the pinion gear 20 and the ring gear 50 needs to be either suppressed or reduced. In other words, the vibration needs to be quickly damped.

In view of this, according to the first embodiment of the present disclosure, an annular hollow portion 22 is provided radially inside (i.e., under gear teeth 21) of the pinion gear 20, and accommodates a vibration absorber 23 to absorb vibration generated at the gear teeth 21. With this, vibrations of the pinion gear 20 and the ring gear 50 caused by the cranking can be damped in the pinion gear 20.

Figure 3A:
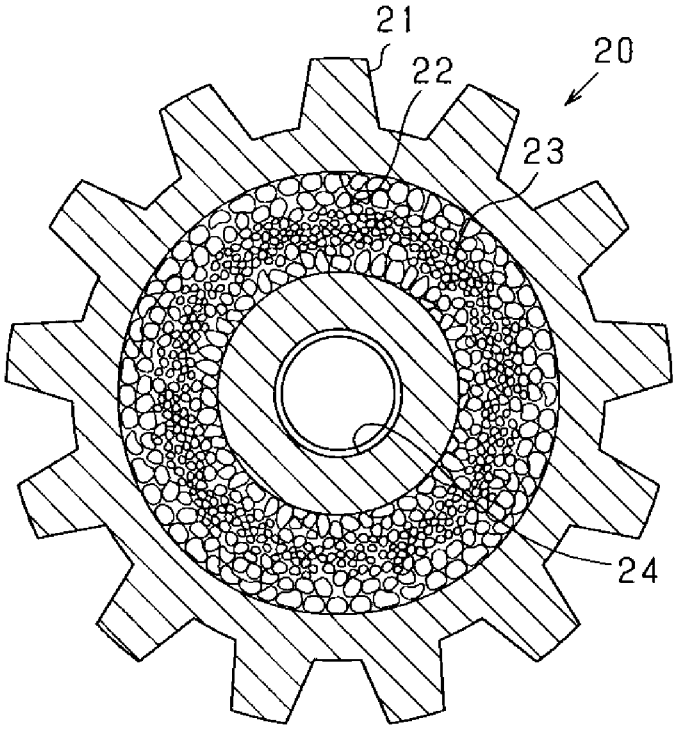
FIGS. 3A and 3B are cross-sectional views collectively illustrating one example of the pinion gear according to the first embodiment of the present disclosure.
Figure 3B:
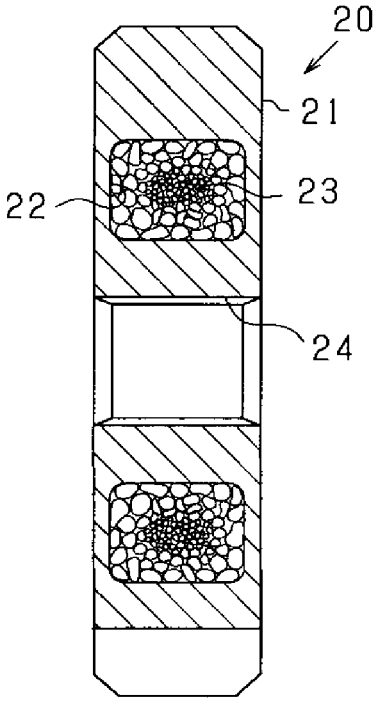

FIGS. 3A and 3B are cross-sectional views collectively illustrating a pinion gear 20. More specifically, FIG. 3A is a transverse cross-sectional view illustrating the pinion gear 20 perpendicular to an axis of the pinion gear 20. FIG. 3B is a longitudinal cross-sectional view illustrating the pinion gear 20 along the axis of the pinion gear 20. The pinion gear 20 includes a shaft hole 24 to allow insertion of the drive shaft 13. A hollow space surrounded and tightly enclosed by an inner wall of the pinion gear 20 is provided in the pinion gear 20 as an annular hollow portion 22. The annular hollow portion 22 is a ring surrounding the shaft hole 24.

As illustrated in FIG. 3A, the annular hollow portion 22 is disposed radially in a middle of the pinion gear 20 between a tooth root circle and a circumference of the shaft hole 24. Further, a wall enclosing (i.e., surrounding) the annular hollow portion 22 is relatively thin. Accordingly, the pinion gear 20 can elastically deform with a small degree of bending, thereby enabling attenuation of the vibration. In addition, since the pinion gear 20 has side walls at both ends in the axial direction, the pinion gear 20 can be effectively thin while securing a necessary degree of rigidity, thereby enabling increase in cubic volume of the annular hollow portion 22.

Further, the vibration absorber 23 has a higher vibration absorption than a surrounding portion surrounding an outer circumference of the annular hollow portion 22 in the pinion gear 20. The vibration absorption represents a degree of ability to damp vibration such that the higher the vibration absorption, the greater the ability of vibration attenuation. The vibration absorber 23 has a property capable of absorbing vibration generated at a given frequency by converting the vibration to thermal energy. The vibration absorber 23 is as a mixture powders prepared by mixing two or more powders respectively having different particle sizes. Further, a particle size of powder stored as a vibration absorber 23 in the annular hollow portion 22 in the vicinity of the wall surrounding the annular hollow portion 22 is different from that at a core of the annular hollow portion 22 each other. That is, the particle size of the powder is increasingly large as it is stored in the annular hollow portion 22 in the vicinity of wall surrounding the annular hollow portion 22 (i.e., in the vicinity of an interface between the annular hollow portion 22 and the pinion gear 20). By contrast, the particle size of the powder stored in a core of the annular hollow portion 22 is smaller.

Now, an exemplary method of producing the pinion gear 20 is described. The pinion gear 20 is produced by melting powder with laser beam in a 3D (three dimensional) printer forming a given shape.

Specifically, in the 3D printer, powder is initially accumulated on an elevatable table to have a default thickness. Then, a laser beam is irradiated in a cross-sectional shape determined based on a blueprint. Accordingly, the powder melts and is solidified, thereby forming a thin layer in the cross-sectional shape. The table is then lowered by a height equivalent to a thickness of a single layer formed in this way. Powder is newly accumulated spreading all over the table to have a height equivalent to the thickness of the single layer. Again, the laser beam is irradiated in a cross-sectional shape, so that the powder melts and is coupled to the layer previously formed. By repeating such a process, the 3D printer produces a pinion gear 20 having a given shape.

Further, with such a 3D printer, the pinion gear 20 is produced without irradiating the laser beam to powder corresponding to the annular hollow portion 22. As a result, the powder is stored in the annular hollow portion 22 of the pinion gear 20 when the pinion gear 20 is completely produced. The powder, however, acts as the vibration absorber 23 stored in the annular hollow portion 22.

Then, the pinion gear 20 produced by the 3D printer is subjected to heat treatment. That is, the pinion gear 20 just produced by the 3D printer is likely to lack the required strength. Hence, by applying the heat treatment to the pinion gear 20, the pinion gear 20 is strengthened. At this moment, by adjusting either a heating temperature or distribution of the powder, a particle size of the powder stored in the annular hollow portion 22 can be effectively increased. That is, due to transmission of heat used in the heat treatment to the powder, the powder melts and is consolidated. As a result, a particle size of the powder positioned in the vicinity of the wall surrounding the annular hollow portion 22 increases. By contrast, since it does not melt, the particle size of the powder stored in the vicinity of the core of the annular hollow portion 22 remains small.

In this way, the particle size of the powder (i.e., the vibration absorber 23) stored in the annular hollow portion 22 in the vicinity of the wall is greater than the particle size of the powder stored in the vicinity of the core of the annular hollow portion 22. When the particle size of the powder stored in the annular hollow portion 22 varies, a frequency absorbed by the powder varies accordingly. Hence, by changing the particle size of the powder stored as the vibration absorber 23, a frequency of absorbable vibration can be increased. Further, since powder of different particle sizes is mixed, small size particles enter gaps between large size particles, thereby enabling more efficient filling. Further, because the powder particles stored in the vicinity of the surface of the annular hollow portion 22 can be increased in size, the powder can be partially strengthened therein, thereby increasing a vibration absorption rate and accordingly reducing generation of noise while enhancing the strength of the pinion gear 20.

As described heretofore, according to the present embodiment, the below described advantages can be obtained.

As described earlier, the cranking noise occurs when the ring gear 50 is driven by the pinion gear 20. That is, the ring gear 50 is affected by variation in engine load caused by a compression stroke and an expansion stroke in the engine. Hence, when the engine load varies, a contact pressure caused between the pinion gear 20 and the ring gear 50 accordingly varies. In such a situation, since the DC motor 11 of the starter 10 is rotated by a driving force prevailing over the change in contact pressure, contact surfaces generate the cranking noise. Vibrations of the ring gear 50 and the pinion gear 20 generated by the cranking are mutually conveyed to each other through the respective contact surfaces therebetween. Since vibrations of the pinion gear 20 and the ring gear 50 can be damped, it is a decisive factor for reducing the cranking noise to promptly damp the vibration in the pinion gear 20. In view of this, according to the present embodiment, vibration generated in the gear teeth 21 is inhibited by the annular hollow portion 22 from traveling in the pinion gear 20, thereby suppressing occurrence of the cranking noise.

In view of this, the annular hollow portion 22 is provided in the pinion gear 20, so that the vibration generated in the gear teeth 21 of the pinion gear 20 can be effectively either suppressed or reduced from radially traveling inward to the drive shaft 13 of the pinion gear 20.

In addition, the annular hollow portion 22 accommodates the powder, such as metal powder, resin powder, etc., acting as the vibration absorber 23, so that the vibration can be more effectively absorbed.

Further, when a particle size of powder varies, a frequency of vibration waves absorbed by the powder (i.e., particles) generally changes. In view of this, the powder having various particle sizes is used as the vibration absorber 23, so that a frequency band of vibration waves absorbed by the powder can be expanded.

Further, the closer to the wall surrounding the annular hollow portion 22 (or an outer peripheral surface of the annular hollow portion 22), the larger the particle size of the powder. Also, the closer to the core of the annular hollow portion 22, the smaller the particle size of the powder. Accordingly, the particle size of the powder located in the vicinity of the core is different from that in the vicinity of the wall surrounding the annular hollow portion 22, so that a frequency band of absorbable vibration waves can be expanded.

Figure 4A:
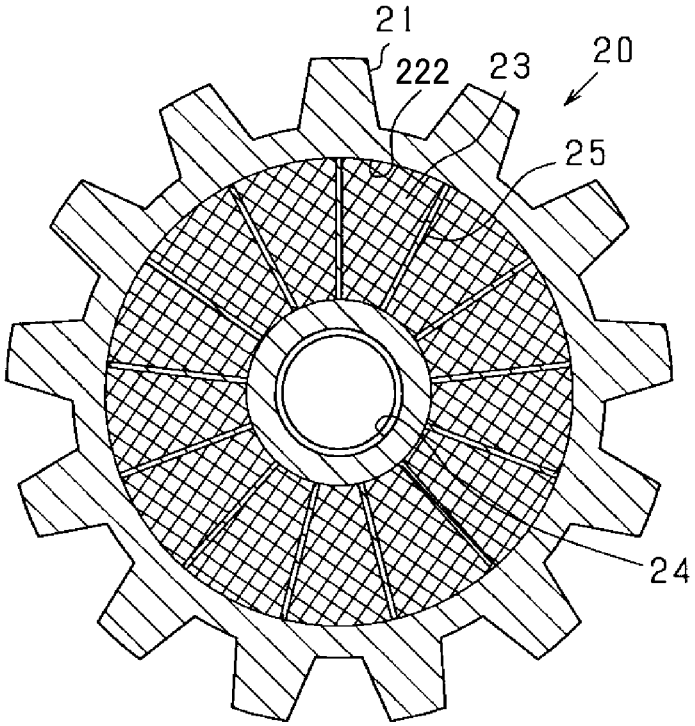
FIGS. 4A and 4B are cross-sectional views collectively illustrating another exemplary pinion gear according to a second embodiment of the present disclosure.
Figure 4B:
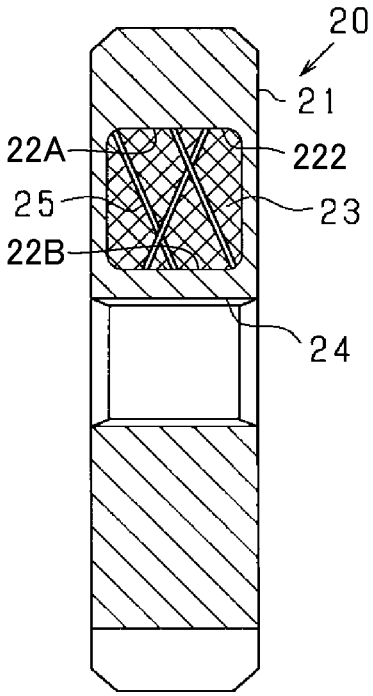

Now, a second embodiment of the present disclosure is herein below described with reference to FIGS. 4A and 4B. FIGS. 4A and 4B are cross-sectional views collectively illustrating a pinion gear 20 of the second embodiment. More specifically, FIG. 4A is a transverse cross-sectional view illustrating the pinion gear 20 perpendicular to an axis of the pinion gear 20. FIG. 4B is a longitudinal cross-sectional view illustrating the pinion gear 20 along the axis of the pinion gear 20.

As shown, according to the second embodiment, multiple connectors 25 are provided in an annular hollow portion 222 to connect a radially outer wall 22A of the annular hollow portion 22 and a radially inner wall 22B thereof as described herein below in more detail.

Specifically, as illustrated in FIG. 4A, the annular hollow portion 222 is disposed radially in a middle of the pinion gear 20 between a tooth root circle and a circumference of the shaft hole 24. The annular hollow portion 222 accommodates a vibration absorber 23 composed of powder. The powder desirably includes two or more different particle sizes.

In the annular hollow portion 222, multiple beam-like connectors 25 are provided to connect the radially outer wall 22A formed in a radially outer portion of the annular hollow portion 222 and the radially inner wall 22B formed in a radially inner portion of the annular hollow portion 222. Each of the connectors 25 is a linear rod-like member made of substantially the same material as the pinion gear 20 and is integrally with the pinion gear 20. These multiple connectors 25 are radially extended at intervals of substantially the same angle around an axis of the pinion gear 20 while intersecting with each other when viewed in a direction perpendicular to the axial direction thereof. Hence, since the connectors 25 support both the radially outer wall 22A and inner wall 22B of the annular hollow portion 222, the connector 25 can reinforce an inner space of the annular hollow portion 222. As a result, the annular hollow portion 222 can be enlarged to allow filling of a larger amount of vibration absorber 23 therein. Such a pinion gear 20 is produced by using a 3D printer, so that the connector 25 can be freely positioned in the annular hollow portion 222.

Further, since it extends radially, the connector 25 acts as a passage for vibration generated by the gear teeth 21 to pass. That is, the vibration generated by the gear tooth 21 may be transmitted to one end of the connector 25 and is further transmitted to an opposite end (i.e., the radially inner wall 22B) via the connector 25 in the annular hollow portion 222. However, since the connector 25 is surrounded by the vibration absorber 23 in the annular hollow portion 222, the vibration is absorbed by the vibration absorber 23. That is, since each of the multiple connectors 25 provided in the annular hollow portion 222 of the pinion gear 20 contacts the vibration absorber 23, an interface between the vibration absorber 23 and the pinion gear 20 in contact with each other is expanded, thereby enabling more effective absorption and attenuation of the vibration.

Figure 5A:
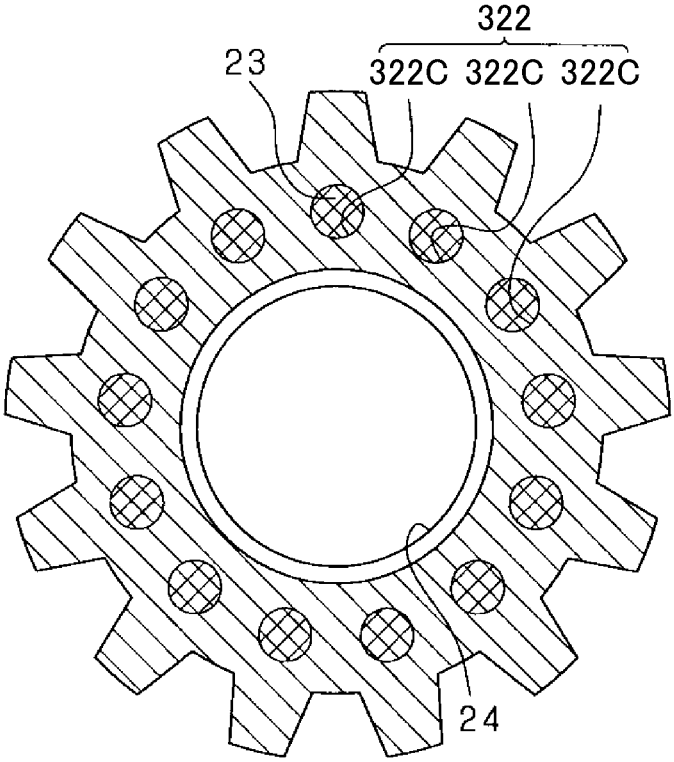
FIGS. 5A and 5B are cross-sectional views collectively illustrating yet another exemplary pinion gear according to a third embodiment of the present disclosure.
Figure 5B:
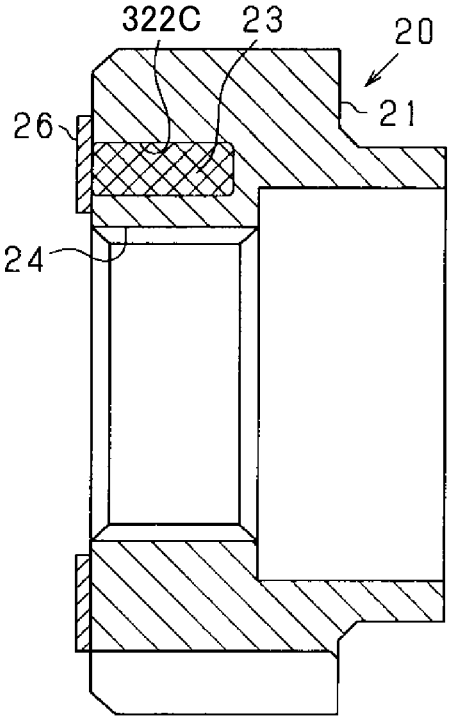

Now, a third embodiment of the present disclosure is herein below described with reference to FIGS. 5A and 5B. That is, FIGS. 5A and 5B are cross-sectional views collectively illustrating a pinion gear 20 of the third embodiment. More specifically, FIG. 5A is a transverse cross-sectional view illustrating the pinion gear 20 perpendicular to an axis of the pinion gear 20. FIG. 5B is a longitudinal cross-sectional view illustrating the pinion gear 20 along the axis of the pinion gear 20.

According to the third embodiment, a hollow portion 322 is composed of multiple hollow portions 322C separately formed below gear teeth 21 respectively aligning in a circumferential direction of a pinion gear 20 as herein below described in detail.

That is, the cylindrical hollow portions 322C are formed in the vicinity of bases of respective gear teeth 21 aligning in the circumferential direction. More specifically, a center of each of the cylindrical hollow portions 322C is positioned on a line extended through an axis of the pinion gear 20 and a center between opposing tooth faces of the same gear tooth 21 corresponding to the cylindrical hollow portion 322C. Further, each of the cylindrical hollow portion 322C is composed of a recess having a circular cross section extended in the axial direction from one side of the pinion gear 20. Since one end of each of the cylindrical hollow portions 322C is opened, a lid 26 is provided to cover the opening of the cylindrical hollow portion 322C.

Further, each of the cylindrical hollow portions 322C accommodates a vibration absorber 23 composed of powder. The powder desirably includes two or more different particle sizes. Further, since it is provided per gear tooth 21, a space of each of the cylindrical hollow portions 322C is relatively narrow. With this, uneven distribution of the vibration absorber 23 can be either suppressed or reduced in each of the cylindrical hollow portions 322C. Further, since the cylindrical hollow portion 322C is provided per gear tooth 21, vibration generated by a corresponding gear tooth 21 can be effectively either suppressed or reduced from radially traveling to a drive shaft 13 via an inside of the pinion gear 20.

Further, in the present embodiment, the pinion gear 20 is prepared by one of pressing, casting and cutting or the like. That is, the recessed hollow portion 322C having the opening at its one end can be produced by using such a conventional method rather than a 3D printer. Hence, after filling the cylindrical hollow portion 322C with the vibration absorber 23, the lid 26 is fixed to the opening by welding. The lid 26 may be prepared per hollow portion 322C as described above. Otherwise, another annular lid 26 capable of covering all the openings can be prepared and fixed thereto. With such a preparation method, the vibration absorber 23 can be arbitrarily stored in the cylindrical hollow portions 322C.

Figure 6A:
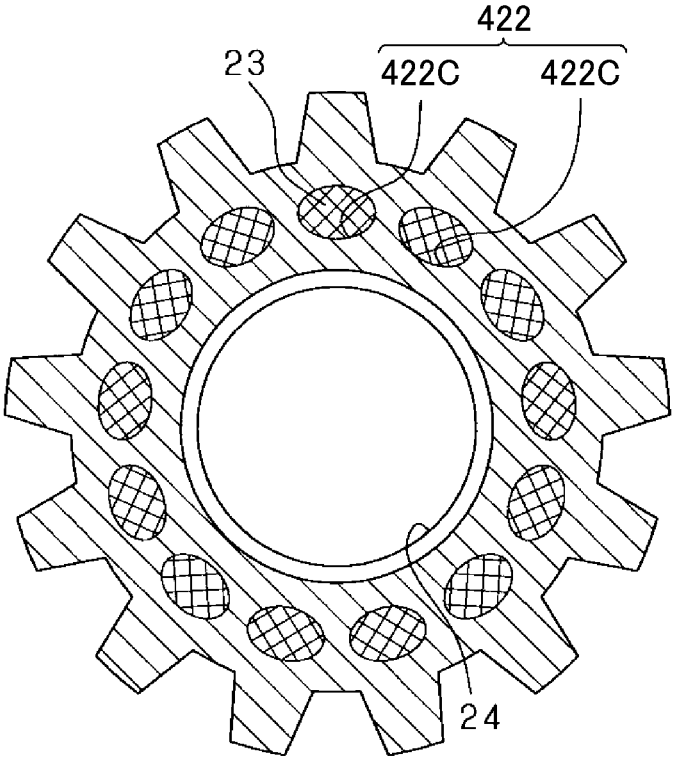
FIGS. 6A and 6B are cross-sectional views collectively illustrating yet another exemplary pinion gear according to a fourth embodiment of the present disclosure.
Figure 6B:
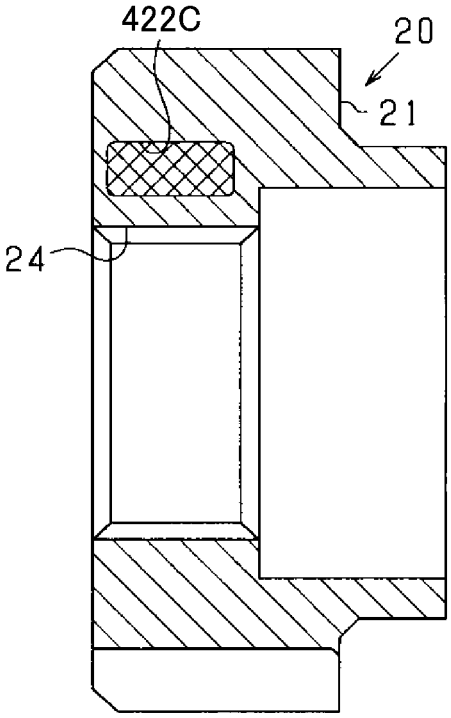

Now, a fourth embodiment of the present disclosure is herein below described with reference to FIGS. 6A and 6B. FIGS. 6A and 6B are cross-sectional views illustrating the pinion gear 20 of the fourth embodiment. More specifically, FIG. 6A is a transverse cross-sectional view illustrating the pinion gear 20 perpendicular to an axis of the pinion gear 20. FIG. 6B is a longitudinal cross-sectional view illustrating the pinion gear 20 along the axis of the pinion gear 20.

As shown, according to the fourth embodiment, a hollow portion 422 is composed of a plurality of cylindrical hollow portions 422C. Each of the cylindrical hollow portions 422C has an oval cross section having a long axis in a circumferential direction of the pinion gear 20 and a short axis in a radial direction thereof as described herein below in more detail.

Specifically, the separate multiple hollow portions 422C are respectively formed below gear teeth 21 in the vicinity of bases of the gear teeth 21 aligning in the circumferential direction. A center of each of the cylindrical hollow portions 422C is positioned on a line extended through an axis of the pinion gear 20 and a center between opposing faces of the same gear tooth 21 corresponding to the cylindrical hollow portion 422C. Since each of the cylindrical hollow portions 422C has the oval cross section, and is accordingly longer in the circumferential direction than in the radial direction of the pinion gear 20, a circumferential dimension of each of the cylindrical hollow portion 422C can be lengthened while maintaining a dimension in the radius direction. With this, a vibration radially transmitted inward from the tooth face can be effectively either suppressed or reduced.

Further, each of the cylindrical hollow portions 422C accommodates a vibration absorber 23 composed of powder. The powder desirably includes two or more different particle sizes. Since it is provided per gear tooth 21, a space of each of the cylindrical hollow portions 422C is relatively narrow. With this, uneven distribution of the vibration absorber 23 in the cylindrical hollow portion 422C can be either suppressed or reduced. Further, since each of the cylindrical hollow portions 422C is provided per gear tooth 21, vibration generated in a corresponding gear tooth 21 can be effectively either suppressed or reduced from radially traveling to a drive shaft 13 via an inside of the pinion gear 20.

Figure 7A:
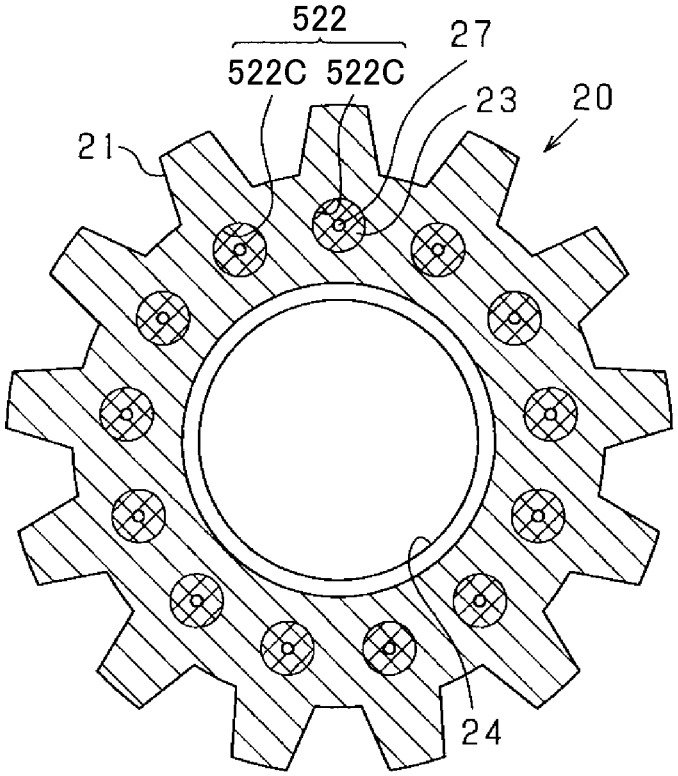
FIGS. 7A and 7B are cross-sectional views collectively illustrating yet another exemplary pinion gear according to a fifth embodiment of the present disclosure.
Figure 7B:
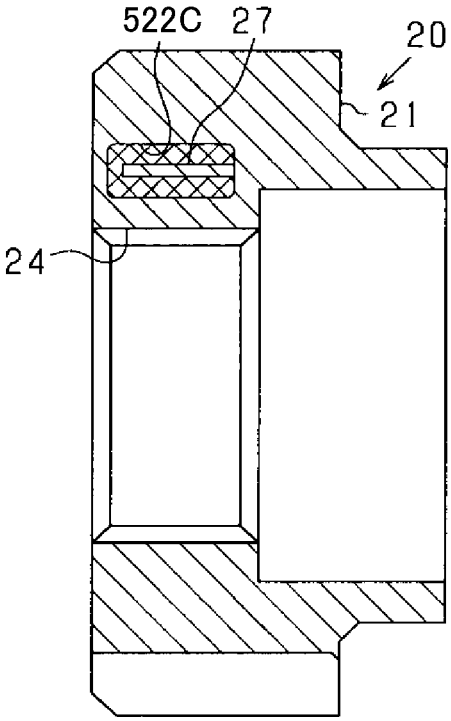

Now, a fifth embodiment of the present disclosure is herein below described with reference to FIGS. 7A and 7B. FIGS. 7A and 7B are cross-sectional views illustrating the pinion gear 20 of the fifth embodiment. More specifically, FIG. 7A is a transverse cross-sectional view illustrating the pinion gear 20 perpendicular to an axis of the pinion gear 20. FIG. 7B is a longitudinal cross-sectional view illustrating the pinion gear 20 along the axis of the pinion gear 20.

As illustrated, according to the fifth embodiment, a columnar protrusion 27 is erected from a bottom of each of cylindrical hollow portions 522C to an interior of the cylindrical hollow portion 522C as described herein below in more detail.

Specifically, a hollow 522 is composed of the cylindrical hollow portions 522C formed in the vicinity of bases of respective gear teeth 21 aligning in a circumferential direction of a pinion gear 20. As illustrated in FIG. 7A, each of the cylindrical hollow portions 522C is disposed radially in a middle of the pinion gear 20 between a tooth root circle and a circumference of the shaft hole 24. Further, each of the cylindrical hollow portions 522C accommodates a vibration absorber 23 composed of powder. The powder desirably includes two or more different particle sizes.

As described above, the columnar protrusion 27 protrudes from the bottom of the cylindrical hollow portion 522C. The protrusion 27 is composed of a rod-shaped linear member and acts as a cantilever. The protrusion 27 is made of substantially the same material as the pinion gear 20 and integral with the pinion gear 20. Each of the cylindrical hollow portions 522C has a hollow cylindrical shape and is surrounded by a circular inner wall. The protrusion 27 extends axially from a center of a round-shaped bottom of the cylindrical hollow portion 522C toward an opposite side thereto. Hence, vibration generated in the gear tooth 21 is also transmitted to the protrusion 27 disposed in the cylindrical hollow portion 522C per gear tooth 21. Since the protrusion 27 is surrounded by the vibration absorber 23, the vibration transmitted to the protrusion 27 can be effectively absorbed by the vibration absorber 23. Further, since the protrusion 27 acting as a part of the pinion gear 20 contacts the vibration absorber 23, an area of the vibration absorber 23 in contact with the pinion gear 20 can be increased, thereby enabling more effective vibration absorption and/or attenuation.

Figure 8A:
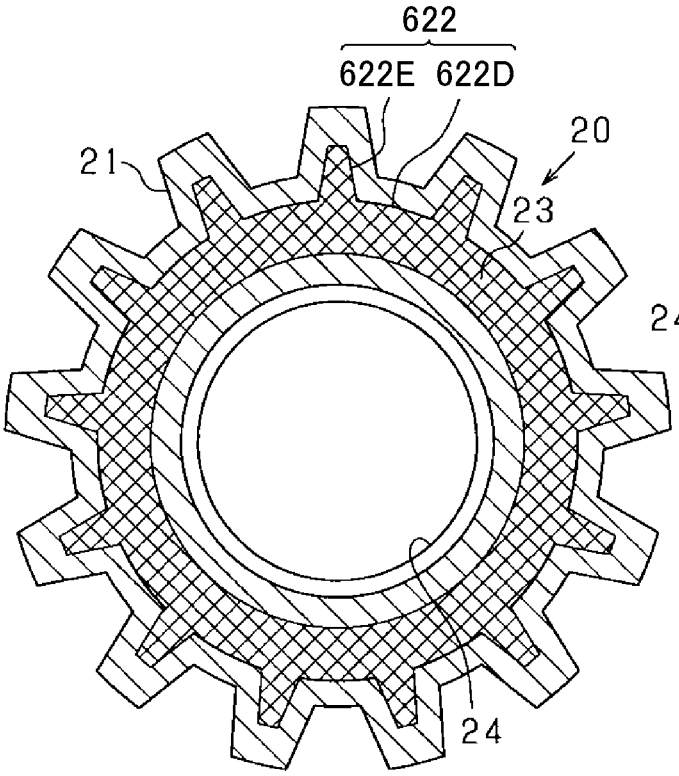
FIGS. 8A and 8B are cross-sectional views collectively illustrating yet another exemplary pinion gear according to a sixth embodiment of the present disclosure.
Figure 8B:
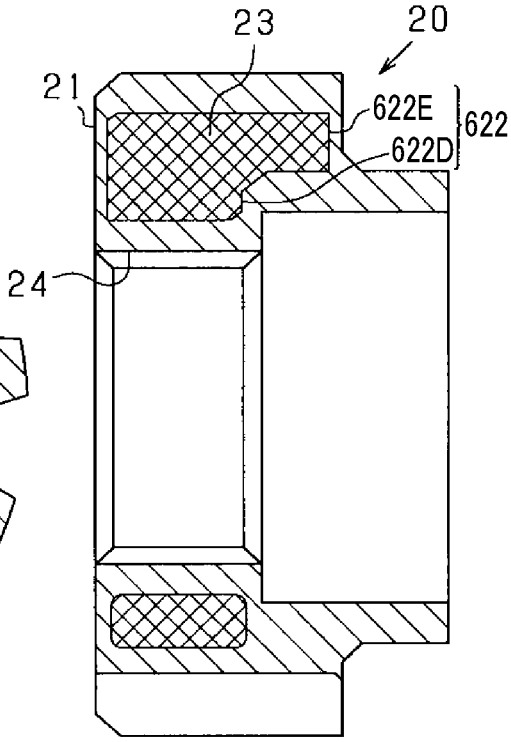

Now, a sixth embodiment of the present disclosure is herein below described with reference to FIGS. 8A and 8B. FIGS. 8A and 8B are cross-sectional views illustrating a pinion gear 20 of the sixth embodiment. More specifically, FIG. 8A is a transverse cross-sectional view illustrating the pinion gear 20 perpendicular to an axis of the pinion gear 20. FIG. 8B is a longitudinal cross-sectional view illustrating the pinion gear 20 along the axis of the pinion gear 20.

As shown, according to the sixth embodiment, a hollow portion 622 is composed of an annular portion located radially inside of gear teeth 21 and multiple convex portions respectively protruding into the gear teeth 21 from the annular portion to oppose to top lands and tooth faces of the gear teeth 21 as described herein below in more detail.

Specifically, the hollow portion 622 includes an annular first hollow portion 622D located radially inside of the gear teeth 21 surrounding a shaft hole 24. The hollow portion 622 also includes multiple second convex hollow portions 622E radially protruding outward from an outer circumference of the cylindrical first hollow portion 622D across a tooth bottom circle to oppose to respective backsides of top lands and tooth faces of the gear teeth 21. The annular first hollow portion 622D and the second convex hollow portions 622E are communicated (i.e., integral) with each other. As illustrated in FIGS. 8A and 8B, the hollow portion 622 is disposed radially in a middle of the pinion gear 20 between a tooth tip circle and a circumference of the shaft hole 24. The hollow portion 622 accommodates a vibration absorber 23 composed of powder. The powder desirably includes two or more different particle sizes.

Hence, since the hollow portion 622 accommodates the vibration absorber 23 and extended along the back sides of the top lands and the tooth faces generating vibration and radially inside of the gear teeth 21 to prevent diffusion of the vibration to the entire pinion gear 20, the vibration can be more effectively absorbed and/or damped.

Figure 9A:
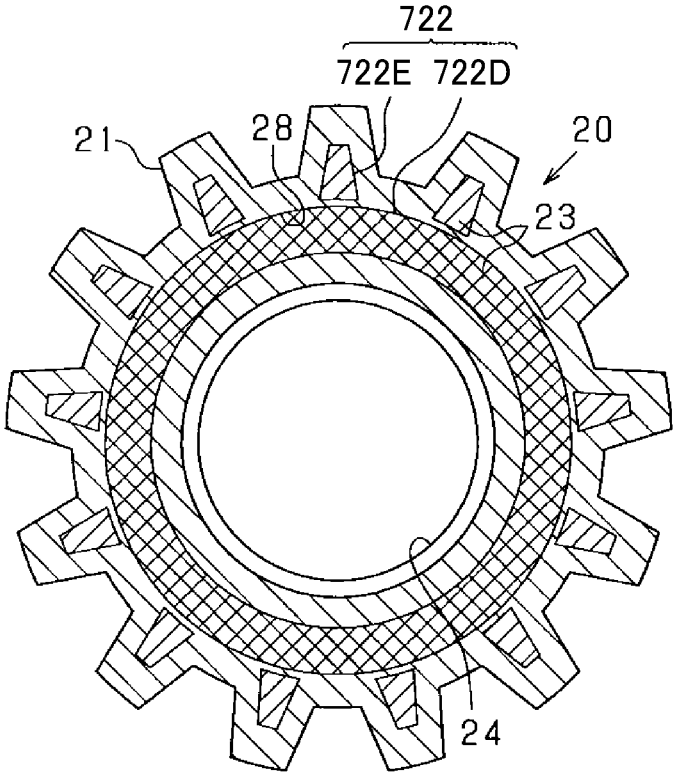
FIGS. 9A and 9B are cross-sectional views collectively illustrating yet another exemplary pinion gear according to a seventh embodiment of the present disclosure.
Figure 9B:
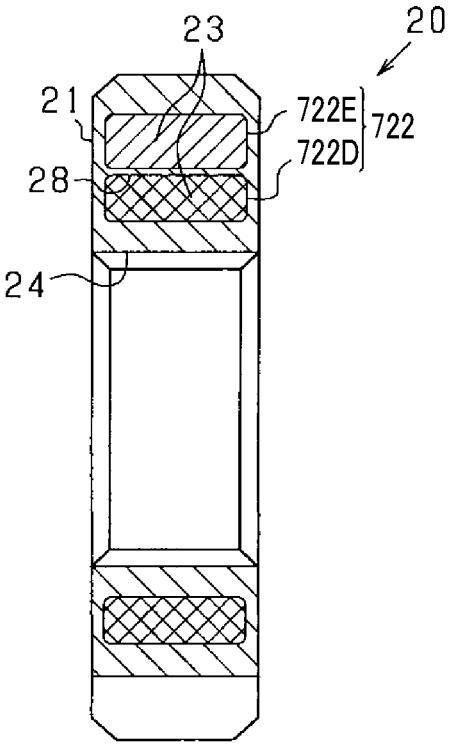

Now, a seventh embodiment of the present disclosure is herein below described with reference to FIGS. 9A and 9B. FIGS. 9A and 9B are cross-sectional views illustrating a pinion gear 20 of the seventh embodiment. More specifically, FIG. 9A is a transverse cross-sectional view illustrating the pinion gear 20 perpendicular to an axis of the pinion gear 20. FIG. 9B is a longitudinal cross-sectional view illustrating the pinion gear 20 along the axis of the pinion gear 20. As shown, according to the seventh embodiment, a hollow portion 722 is composed of an annular first hollow part 722D and multiple second hollow parts 722E respectively disposed inside of gear teeth between the gear teeth and the annular first hollow part 722D. The annular first hollow part 722D and each of the second hollow parts 722E are partitioned by a circumferential partition 28 extended in a circumferential direction of the pinion gear 20.

Specifically, the annular first hollow part 722D is located radially inside of the gear teeth 21 to surround a shaft hole 24. Each of the second hollow parts 722E has a rectangular lateral cross section and is extended in a widthwise direction of the gear tooth. Each of the second hollow parts 722E is radially extended across a tooth root circle to face a backside of a corresponding gear tooth 21. Further, between the annular first hollow part 722D and each of the second hollow parts 722E, the partition 28 is extended in the circumferential direction. Hence, the pinion gear 20 includes the annular first hollow part 722D and the second hollow parts 722E facing the back sides of the faces of corresponding one of the gear teeth 21. As illustrated in FIGS. 9A and 9B, the hollow portion 722 is disposed radially in a middle of the pinion gear 20 between a tooth tip circle and a circumference of the shaft hole 24. Further, the hollow portion 722 accommodates a vibration absorber 23 composed of powder. The powder desirably includes two or more different particle sizes. Further, one of a type, a particle size and material of the vibration absorber 23 stored in the annular first hollow part 722D may be different from that in the second hollow portions 722E. Further, these vibration absorbers 23 can be powder and liquid, respectively. By using different types of vibration absorbers 23, vibrations of various frequencies can be attenuated.

As described above, since the annular hollow portion 722 accommodating the vibration absorber 23 is provided at each of positions facing the back sides of the faces of the gear tooth that generates a vibration and radially inside of the gear teeth 21 that diffuses the vibration, the vibration can be more effectively absorbed and/or damped. Further, since the annular first hollow part 722D and the second hollow parts 722E are partitioned and the second hollow portion 722E is disposed per gear tooth 21, uneven distribution of the vibration absorber 23 therein can be either suppressed or reduced.

Figure 10A:
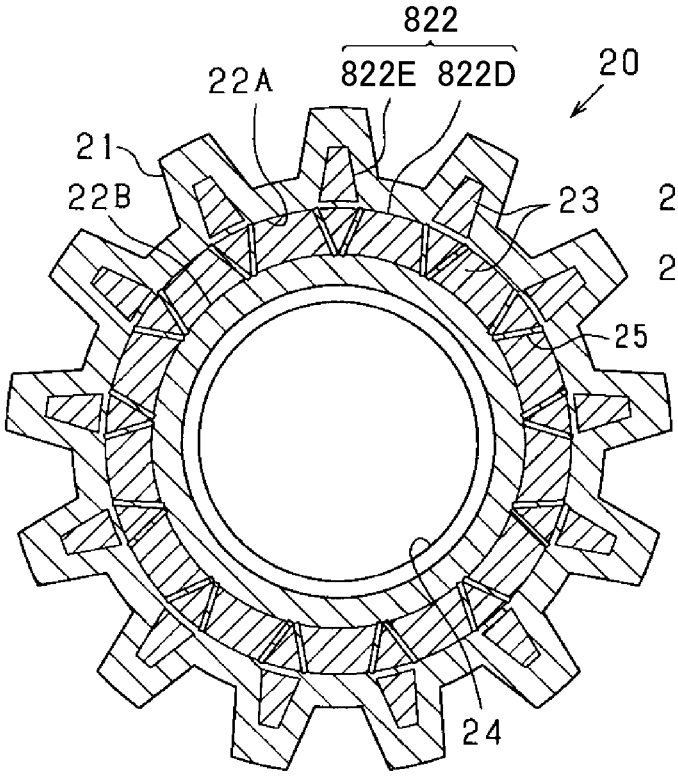
FIGS. 10A and 10B are cross-sectional views collectively illustrating yet another exemplary pinion gear according to an eighth embodiment of the present disclosure.
Figure 10B:
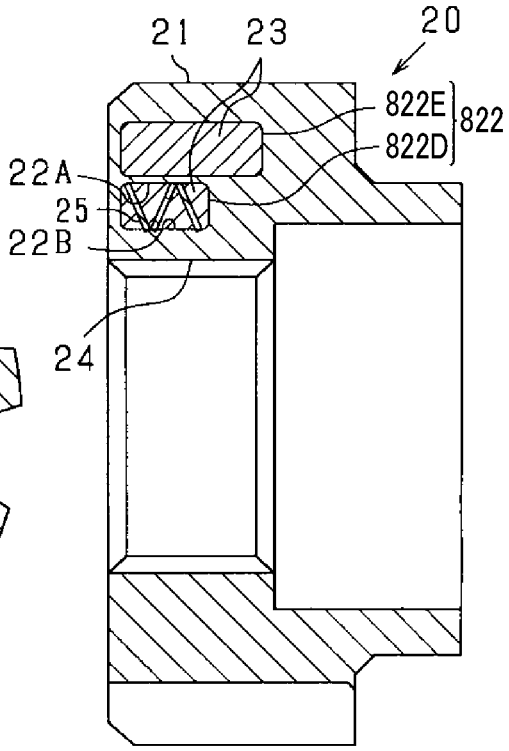

Now, an eighth embodiment of the present disclosure is herein below described with reference to FIGS. 10A and 10B. FIGS. 10A and 10B are cross-sectional views illustrating a pinion gear 20 of the seventh embodiment. More specifically, FIG. 10A is a transverse cross-sectional view illustrating the pinion gear 20, perpendicular to an axial direction of the pinion gear 20. FIG. 10B is a longitudinal cross-sectional view illustrating the pinion gear 20 along the axis of the pinion gear 20.

As shown, according to the eighth embodiment, multiple connectors 25 are provided in an annular first hollow part 822D having the same configuration as the annular first hollow portion 722D of the seventh embodiment to connect an radially outer wall 822A of the annular first hollow portion and an radially inner wall 822B thereof with each other as described herein below in more detail.

Specifically, a hollow portion 822 is composed of an annular first hollow part 822D located radially inside of the gear teeth 21 to surround a shaft hole 24. Each of the second hollow parts 822E has a rectangular lateral cross section and is extended in a widthwise direction of the gear tooth. Each of the second hollow parts 822E is radially extended across a tooth root circle to face a backside of a corresponding gear tooth 21. That is, between the annular first hollow part 822D and each of the second hollow parts 822E, a circumferential partition 28 is extended in a circumferential direction of a pinion gear 20. As illustrated in FIGS. 10A and 10B, the hollow portion 822 is disposed radially in a middle of the pinion gear 20 between a tooth tip circle and a circumference of the shaft hole 24.

Further, multiple connectors 25 are provided in the annular first hollow part 822D to connect a radially outer wall 22A located radially outside of the annular first hollow part 822D and a radially inner wall 22B located radially inside thereof. Each of the connectors 25 is composed of a rod-like linear member made of substantially the same material as the pinion gear 20 and is integrally produced with the pinion gear 20. Each of the connectors 25 is disposed per gear tooth 21. Hence, since the connectors 25 disposed in this way support the radially outer wall 22A and the radially inner wall 22B of the annular first hollow part 822D, a space of the annular first hollow part 822D can be strengthened.

Further, the hollow portion 822 accommodates a vibration absorber 23 composed of powder. The powder desirably includes two or more different particle sizes. Further, a type of the vibration absorber 23 stored in the annular first hollow part 822D is preferably different from that in the second hollow parts 822E. That is, by using different types of a vibration absorber 23, vibrations of various frequencies can be attenuated.

Figure 11A:
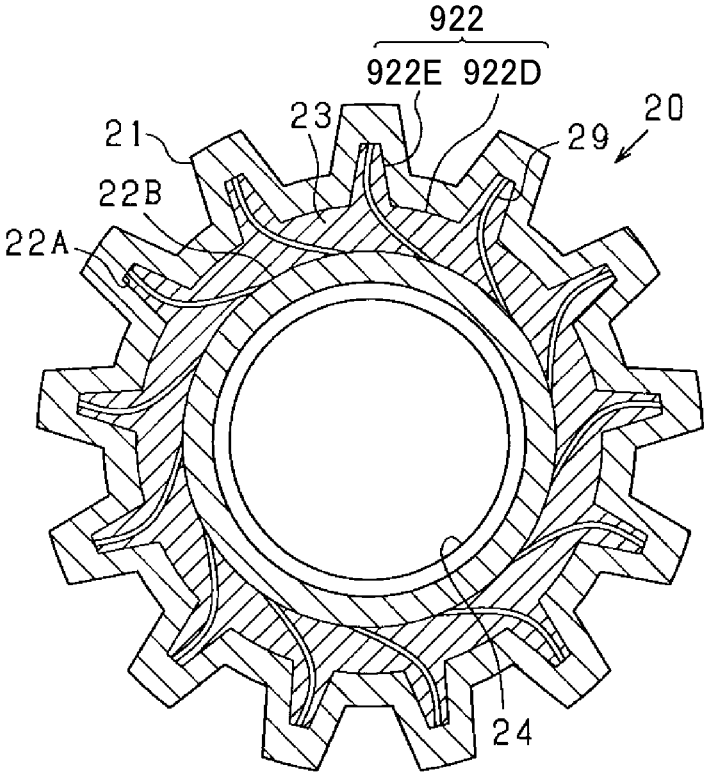
FIGS. 11A and 11B are cross-sectional views collectively illustrating yet another exemplary pinion gear according to a ninth embodiment of the present disclosure.
Figure 11B:
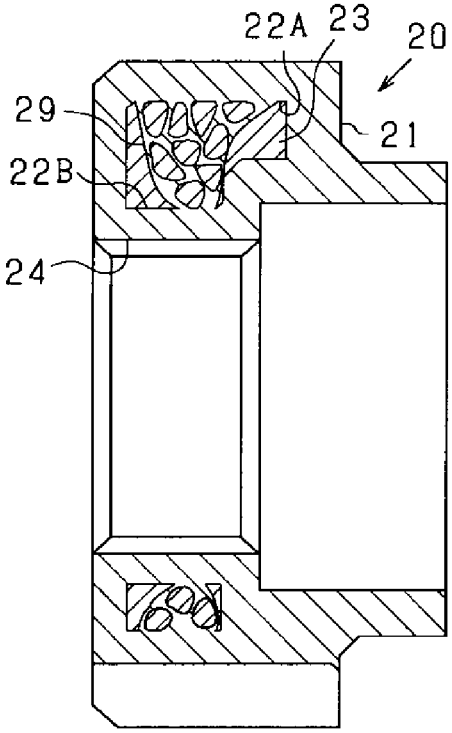

Now, a ninth embodiment of the present disclosure is herein below described with reference to FIGS. 11A and 11B. That is, FIGS. 11A and 11B are cross-sectional views collectively illustrating a pinion gear 20 according to the ninth embodiment. More specifically, FIG. 11A is a transverse cross-sectional view illustrating the pinion gear 20 perpendicular to an axis of the pinion gear 20. FIG. 11B is a longitudinal cross-sectional view illustrating the pinion gear 20 along the axis of the pinion gear 20.

According to the ninth embodiment, multiple blocking members 29 are provided in a hollow portion 922 to inhibit a vibration absorber 23 from moving in a circumferential direction of the pinion gear 20 in the hollow portion 22 as described herein below in more detail.

That is, the hollow portion 922 includes an annular first hollow portion 922D radially inside of gear teeth 21 to surround a shaft hole 24. The hollow portion 922 also includes multiple second hollow portions 922E facing back sides of top lands and tooth faces of the gear teeth 21. The annular first hollow portion 922D and the second hollow portions 922E are communicated (i.e., integral) with each other. As illustrated in FIGS. 11A and 11B, the hollow portion 922 is disposed radially in a middle of the pinion gear 20 between a tooth tip circle and a circumference of the shaft hole 24. The hollow portion 922 accommodates a vibration absorber 23 composed of powder. The vibration absorber 23 is desirably composed of powder having two or more different particle sizes.

As illustrated, in the hollow portion 922, the multiple blocking members 29 connect radially outer walls 22A of the second hollow portions 922E with a radially inner wall 22B of the annular first hollow portion 922D. Each of the blocking members 29 is composed of a wall-like member having a curved cross-section made of the same material as the pinion gear 20. The blocking members 29 are arranged one by one in the circumferential direction per gear tooth 21 at even intervals, respectively. Hence, since the wall-like blocking member 29 is provided per gear tooth 21, movement and accordingly uneven distribution of the vibration absorber 23 can be either suppressed or reduced. In this respect, each of the blocking members 29 is desirably porous (i.e., mesh-like) by having multiple holes. That is, vibration generated in the gear tooth 21 is also transmitted to the blocking member 29 in the hollow portion 922. However, since multiple holes are formed in the blocking member 29 and allow the vibration absorber 23 to pass therethrough, the vibration can be more effectively absorbed and/or damped.

Figure 12A:
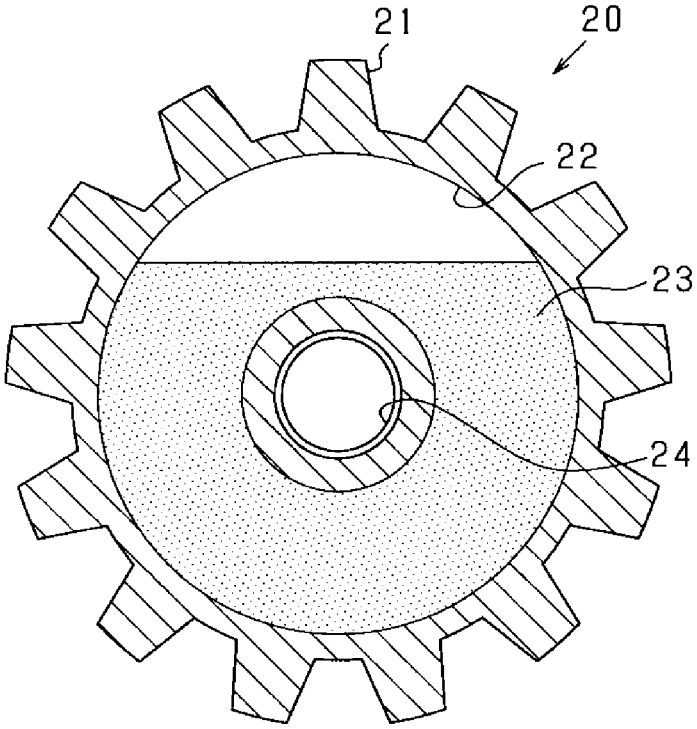
FIGS. 12A and 12B are cross-sectional views collectively illustrating a modification of the pinion gear.
Figure 12B:
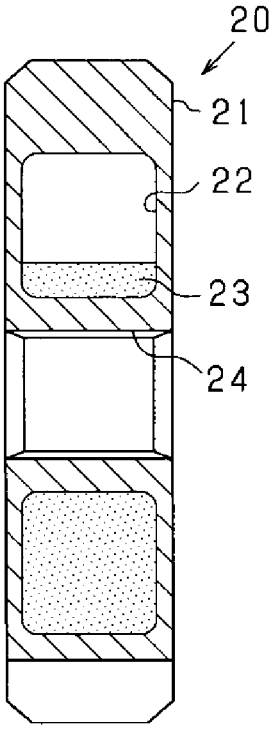

Now, various modifications of the above-described embodiments are herein below described with reference to FIG. 12A and FIG. 12B. That is, the present invention is not limited to the above-described embodiments and may be carried out by modifying them as follows. For example, the following different exemplary modifications may be applied separately or in any combination to each of the above-described embodiments.

First, although it is produced by the 3D printer in the above-described first, second and fourth to eighth embodiments, the pinion gear 20 can be produced by casting, cutting, or pressing and the like.

Further, although the vibration absorber 23 is composed of the same powder in a fused or unfused state as used by the 3D printer of the above-described first, second and fourth to eighth embodiments, the vibration absorber 23 can be composed of different various powders. In such a situation, the different powder may be stored in the annular hollow portion 22 of a pinion gear 20 through a newly employed communicating hole therein after ejecting a powder through the hole when the pinion gear 20 is produced by the 3D printer.

Further, as shown in FIG. 12, instead of the powder, a prescribed liquid may be employed as a vibration absorber and stored in the annular hollow portion 22. For example, either a single component liquid, such as water, alcohol, oil, refrigerant, etc., or a mixture of liquids may be used. In such a situation, the annular hollow portion 22 may be wholly or partially filled with the liquid. Further, in the situation, a pressure of the annular hollow portion 22 can be controlled to cause the liquid to perform state transition due to heat generated in the annular hollow portion 22 when the pinion gear 20 is driven.

Further, a rate at which vibration travels through a liquid is smaller than a rate at which vibration travels through a solid. In view of this, by adjusting either a type or a combination of liquid stored in the annular hollow portion 22, vibration can be either damped or suppressed at an interface between those liquids having different physical properties or the like. Further, by partially transmitting the vibration to the liquid in the annular hollow portion 22 and attenuating it therein, an energy of a vibration wave to be emitted outside as a noise can be minimized, thereby enabling noise reduction. Further, when the annular hollow portion 22 is partially filled with the liquid, since an interface with a gas appears, the interface can either absorb or damp the vibration. In such a situation, however, the vibration absorber is likely to be unevenly distributed. In such a situation, however, due to this uneven distribution, the pinion gear 20 can sharply stop rotation.

As described heretofore, according to one embodiment of the present disclosure provides a novel pinion gear 20 fixed to a drive shaft 13 of a starter 10 starting an internal combustion engine. The pinion gear rotates a ring gear 50 provided to the internal combustion engine by meshing therewith. The pinion gear 20 includes gear teeth 21 disposed on its outer circumference and an annular hollow portion 22 located inside of the gear teeth, and a vibration absorber 23 stored in the annular hollow portion. The vibration absorber has a higher vibration absorption property at a core of the annular hollow portion than at an outer edge thereof.

When a starter 10 starts a combustion engine, compression and expansion are repeated in a cylinder of the combustion engine. In a cylinder compression stage, since a pinion gear needs to overcome a compression reaction force and rotate a ring gear, a large load is generated between the pinion gear and the ring gear. Further, during a cylinder expansion stage, since the ring gear is accelerated by expansion of a compressed gas in a direction of rotation thereof, a pinion gear is rotated by the ring gear. In this situation, a face of a tooth of the pinion gear contacting the ring gear and receiving a stress therefrom is alternated with another face of the tooth, and vibrations of a sliding noise and a collision noise respectively caused by sliding and collision of the ring gear and the pinion gear therebetween are transmitted from the faces to the pinion gear and the ring gear. Due to absence of attenuation of these vibrations, unpleasant noises remain such that the noise either becomes louder or echoes.

In view of this, according to one aspect of the present disclosure, transmission of the vibrations from the gear teeth to a drive shaft is either suppressed or reduced by the annular hollow portion in the pinion gear with the above-described configuration. Further, the vibration transmitted to the annular hollow portion is absorbed by the vibration absorber stored in the hollow portion, the vibration can be more effectively either suppressed or reduced. Further, vibration generated in the ring gear by contacting the pinion gear can be satisfactorily reduced in a process in which the vibration is transmitted due to the contact from the ring gear toward an axis of the pinion gear. That is, the vibration of the ring gear can also be reduced. That is, if the ring gear and the pinion gear are in contact with each other so that the vibration is transmitted efficiently from the ring gear to the pinion gear, a cranking noise generated in the pinion gear and the ring gear side can be efficiently reduced. As a result, the sliding noise, the collision noise and a rolling noise or the like generated between the pinion gear and the ring gear can be damped and reduced. That is, if the ring gear and the pinion gear are in contact with each other so that the vibration is transmitted efficiently from the ring gear to the pinion gear, a cranking noise generated in the pinion gear and the ring gear side can be efficiently reduced.

In another embodiment of the present disclosure, a shaft hole 24 is provided to allow insertion of the drive shaft and the annular hollow portion surrounds the shaft hole. Accordingly, by providing the annular hollow portion in the pinion gear, radially inward transmission of vibration generated by each tooth of the pinion gear to the drive shaft can be satisfactorily either suppressed or reduced.

In yet another embodiment of the present disclosure, a connector 25 is provided to connect a radially outer wall 22A of the annular hollow portion and a radially inner wall 22B of the annular hollow portion with each other. The radially outer wall serves as a radially outer part of the hollow portion and the radially inner wall serves as a radially inner part of the hollow portion. Accordingly, by providing the connecting portion in the annular hollow portion, a space of the annular hollow portion can be strengthened. Further, vibration generated in gear teeth is transmitted to the connecting portion in the annular hollow portion. In such a situation, however, since the connecting portion is surrounded by a vibration absorber, the vibration transmitted to the connecting portion is easily absorbed by the vibration absorber. Therefore, the vibration can be more effectively absorbed and damped.

In yet another embodiment of the present disclosure, at least one blocking member 29 is disposed in the annular hollow portion to inhibit the vibration absorber from moving in a circumferential direction of the pinion gear in the annular hollow portion. Hence, by blocking movement of the vibration absorber in the circumferential direction, uneven distribution in the vibration absorber can be either suppressed or reduced. Further, the vibration generated in the gear teeth is also transmitted to the blocking member in the annular hollow portion. However, since the blocking member is surrounded by the vibration absorber, the vibration transmitted to the blocking member can be readily absorbed by the vibration absorber. Therefore, the vibration can be more effectively absorbed and damped.

In yet another embodiment of the present disclosure, the annular hollow portion includes at least two cylindrical hollow portions 322C arranged per tooth in a circumferential direction of the pinion gear. Accordingly, by providing the at least two cylindrical hollow portions per tooth, vibration generated in the tooth and transmitted radially inward of the pinion gear to the drive shaft can be satisfactorily either suppressed or reduced. Further, by providing the at least two cylindrical hollow portions per tooth, uneven distribution of the vibration absorber can be either suppressed or reduced in the annular hollow portion.

In yet another embodiment of the present disclosure, each of the at least two cylindrical hollow portions has a flat cross-sectional shape longer in a circumferential direction and shorter in a radial direction of the pinion gear. Accordingly, since each of the at least two cylindrical hollow portions is longer in the circumferential direction than in the radial direction, it is possible to increase a circumferential dimension while maintaining a radial dimension in each of the at least two cylindrical hollow portions. Accordingly, transmission of the vibration toward the drive shaft through the pinion gear can be further effectively suppressed.

In yet another embodiment of the present disclosure, the annular hollow portion includes: an annular inner hollow part located radially inside of gear teeth of the pinion gear; and at least two back side hollow parts located at respective positions facing back sides of tooth faces of a gear tooth. That is, hollow portions are respectively provided radially inside of the gear teeth surrounding the shaft to prevent vibration from diffusing to the entire pinion gear and portions facing back sides of respective tooth faces in which vibrations occur. Hence, by filling the vibration absorber in the hollow portions, the vibration can be more effectively absorbed and damped.

In yet another embodiment of the present disclosure, the annular hollow portion includes a first hollow part 722D located radially inside of gear teeth of the pinion gear surrounding a shaft hole; at least two second hollow parts 722E located at respective positions facing back sides of faces of a gear tooth; and a partition 28 extended in the circumferential direction to separate the first hollow part and the at least two second hollow parts from each other.

That is, the hollow portions are provided at the sites facing the back sides of the tooth faces at which the vibrations occur, and the site radially inside of the gear teeth to prevent diffusion thereof to all over the pinion gear. Hence, since the vibration absorber is stored in the hollow portions, the vibration can be more effectively absorbed and damped. Further, since the first hollow portion and the second hollow portions are separated from each other, and the second hollow portions are provided per gear tooth, uneven distribution of the vibration absorber can be effectively suppressed.

In yet another embodiment of the present disclosure, the vibration absorber includes powder. Accordingly, by filling the hollow portion with the powder such as metal powder, resin powder, etc., as the vibration absorber, the vibration can be effectively absorbed.

In yet another embodiment of the present disclosure, the powder is a mixture having two or more different particle sizes. That is, in accordance with a particle size of powder, a width of a frequency range in which vibration can be attenuated changes. In view of this, powder having two or more particle sizes is employed as a vibration absorber to increase a frequency of an absorbable vibration wave. That is, by using powder having two or more particle sizes, the vibration can be more effectively absorbed.

In yet another embodiment of the present disclosure, a particle size of powder stored as the vibration absorber in the vicinity of a wall surrounding the annular hollow portion is different from that stored in a core of the annular hollow portion. The core corresponds to the vicinity of a center of a cross section of the annular hollow portion. Further, the particle size of the powder stored in the vicinity of the wall is greater than that stored in the core of the hollow portion.

The closer to the wall surrounding the annular hollow portion 22 (i.e., an outer peripheral surface of the annular hollow portion 22, the larger the particle size of powder. Accordingly, since the particle size of the powder located in the vicinity of the core of the annular hollow portion 22 is different from that in the vicinity of the wall surrounding the annular hollow portion 22, a frequency band of an absorbable vibration wave can be expanded.

In yet another embodiment of the present disclosure, the vibration absorber is composed of liquid. That is, a rate at which vibration travels through the liquid is smaller than the rate at which vibration travels through the solid. In view of this, by adjusting either a type or a combination of liquid stored in the annular hollow portion, vibration can be either damped or suppressed at an interface between those liquids having different physical properties or the like. Further, since it easily changes own pressure distribution, for example, by changing density in response to a vibrating wave, the liquid can easily absorb the vibration. Further, since it easily changes own pressure distribution, for example, by changing density in response to a vibrating wave, the liquid can easily absorb the vibration. In view of this, by partially transmitting the vibration to the liquid stored in the annular hollow portion, thereby attenuating it therein, an energy of a vibration wave emitted outside as a noise can be minimized, thereby enabling reduction of the noise.

Numerous additional modifications and variations of the present disclosure are possible in light of the above teachings. It is therefore to be understood that within the scope of the appended claims, the present disclosure may be executed otherwise than as specifically described herein. For example, the pinion gear is not limited to the above-described various embodiments and may be altered as appropriate. Further, the starter is not limited to the above-described various embodiments and may be altered as appropriate.

What is claimed is:

1. A pinion gear fixed to a drive shaft of a starter for starting an internal combustion engine, the pinion gear rotating a ring gear provided to the internal combustion engine by meshing therewith, the pinion gear comprising:

gear teeth disposed on an outer circumference of the pinion gear;

a hollow portion located radially inside of each of the gear teeth, and a vibration absorber stored in the hollow portion, wherein the vibration absorber has a higher vibration absorption property than a portion of the pinion gear surrounding the hollow portion.

2. The pinion gear as claimed in claim 1, further comprising a shaft hole to allow insertion of the drive shaft, wherein the hollow portion is annular and surrounds the shaft hole.

3. The pinion gear as claimed in claim 2, further comprising at least one connector to connect an radially outer wall of the annular hollow portion and an radially inner wall of the annular hollow portion with each other, the radially outer wall serving as a radially outer part of the hollow portion, the radially inner wall serving as a radially inner part of the hollow portion.

4. The pinion gear as claimed in claim 2, further comprising at least one blocking member disposed in the annular hollow portion to inhibit the vibration absorber from moving in a circumferential direction of the pinion gear in the annular hollow portion.

5. The pinion gear as claimed in claim 2, wherein the hollow portion includes:

an annular inner hollow part located radially inside of each of the gear teeth of the pinion gear, the annular inner hollow part surrounding the shaft hole; and at least two back side hollow parts located at respective positions facing back sides of top lands and tooth faces of the gear teeth.

6. The pinion gear as claimed in claim 2, wherein the annular hollow portion includes:

a first hollow part located radially inside of each of the gear teeth of the pinion gear, the annular inner hollow part surrounding the shaft hole;

at least two second hollow parts located at respective positions facing back sides of top lands and faces of the gear teeth; and a circumferential partition extended in the circumferential direction to separate the first hollow part and the at least two second hollow parts from each other.

7. The pinion gear as claimed in claim 1, wherein the annular hollow portion includes at least two cylindrical hollow portions arranged per tooth in a circumferential direction of the pinion gear.

8. The pinion gear as claimed in claim 7, wherein each of the at least two cylindrical hollow portions has a flat cross-sectional shape longer in a circumferential direction than in a radial direction of the pinion gear.

9. The pinion gear as claimed in claim 1, wherein the vibration absorber is composed of powder.

10. The pinion gear as claimed in claim 9, wherein the powder is a mixture having two or more different particle sizes.

11. The pinion gear as claimed in claim 1, wherein a particle size of powder stored as the vibration absorber in the vicinity of a wall surrounding the annular hollow portion is different from that stored in a core of the annular hollow portion, wherein the core corresponds to the vicinity of a center of a cross section of the annular hollow portion, wherein the particle size of the powder stored in the vicinity of the wall is greater than that stored in the core of the hollow portion.

12. The pinion gear as claimed in claim 1, wherein the vibration absorber is composed of liquid.

13. A starter to start a combustion engine comprising a transmission, wherein the transmission includes the pinion gear as claimed in claim 1.

* * * * *